US010028589B2

(12) United States Patent
Polevoy et al.

(10) Patent No.: US 10,028,589 B2
(45) Date of Patent: Jul. 24, 2018

(54) THREE DIMENSIONAL CONNECTION SYSTEM FOR BED FRAME

(71) Applicants: Richard S. Polevoy, Teaneck, NJ (US); Paul Eric Carlson, Skaneateles, NY (US)

(72) Inventors: Richard S. Polevoy, Teaneck, NJ (US); Paul Eric Carlson, Skaneateles, NY (US)

(73) Assignee: FINGERLAKES INTELLECTUAL PROPERTY LLC, Teaneck, NJ (US)

( * ) Notice: Subject to any disclaimer, the term of this patent is extended or adjusted under 35 U.S.C. 154(b) by 94 days.

(21) Appl. No.: 14/924,138

(22) Filed: Oct. 27, 2015

(65) Prior Publication Data

US 2016/0106222 A1 Apr. 21, 2016

Related U.S. Application Data

(63) Continuation of application No. 12/660,694, filed on Mar. 2, 2010.

(60) Provisional application No. 61/165,492, filed on Mar. 31, 2009.

(51) Int. Cl.
*A47C 19/02* (2006.01)
*A47C 19/00* (2006.01)

(52) U.S. Cl.
CPC ..... *A47C 19/024* (2013.01); *A47C 19/005* (2013.01); *A47C 19/025* (2013.01)

(58) Field of Classification Search
CPC ... A47C 19/005; A47C 19/021; A47C 19/024; A47C 19/025
See application file for complete search history.

(56) References Cited

U.S. PATENT DOCUMENTS

| | | | | |
|---|---|---|---|---|
| 3,537,114 | A | 11/1970 | Mis | |
| 4,007,502 | A | 2/1977 | Mis | |
| 4,627,120 | A | 12/1986 | Harris | |
| 5,740,568 | A * | 4/1998 | Elliott | A47C 19/005 5/295 |
| 6,397,412 | B1 | 6/2002 | Quintile | |
| 6,418,578 | B1 * | 7/2002 | Polevoy | A47B 91/00 16/18 CG |
| 2005/0278848 | A1 * | 12/2005 | Polevoy | A47C 19/005 5/201 |

* cited by examiner

*Primary Examiner* — Nicholas F Polito
(74) *Attorney, Agent, or Firm* — Klauber & Jackson LLC

(57) ABSTRACT

A connection system for use in joining structural members of a bed frame together. One of the structural members has a wedge and the other of the structural members has a cavity formed in a receiver. The wedge has a plurality of exterior surfaces that contact with a plurality of interior surfaces formed in the cavity. There may be four interior and exterior surfaces of the wedge and receiver and at least two of the surfaces taper inwardly in the downward direction. The interfitting of the wedge into the receiver make a solid connection that is enhanced by weight of the bedding positioned thereon. The connection resists twisting forces as well as lateral and fore and aft forces.

10 Claims, 21 Drawing Sheets

THREE DIMENSIONAL CONNECTION SYSTEM FOR BED FRAME

CROSS REFERENCE TO RELATED APPLICATIONS

The present patent application is based upon and hereby claims priority to U.S. Provisional Patent Application, Ser. No. 61/165,492 filed Mar. 31, 2009 and the specification of that Provisional Application is hereby incorporated herein in its entirety by reference.

FIELD OF THE INVENTION

The present invention relates to a bed frame for supporting a mattress or mattress set and, more particularly, to a bed frame having an improved interconnection between the side rails and a cross member.

BACKGROUND OF THE INVENTION

There are currently in use conventional bed frame assemblies that are used for supporting a mattress or mattress set and such bed frame assemblies are normally made up of two side rails and at least one cross member. The bed frame supports the load of a mattress set by means of multiple support legs.

With many bed frames, the side rails and cross member are made of a metal, generally steel, and the connections between the side rails with the cross members are also therefore made up of metal components that interfit to join the cross members to the side rails. Due to the difficulties of actually shipping a completed bed frame, conventional bed frames are delivered to the customer in an unassembled state, and then assembled at the site where the bed frame is intended to be located and used.

One difficulty with such bed frames and the assembly thereof, however, is that tools may be required for the on site assembly of the bed frames and therefore, if the tools are not available, the assembly cannot be done. Further, tool assemblies can be difficult and complicated.

While there are some bed frames that are available that can be assembled together without the use of tools, those bed frames are made of interlocking stamped sheet metal plates. These sheet metal components can be sharp and dangerous as well as heavy. The weight of bedding and bed occupants create a downward force on the bedding and that force must be transferred to the floor that supports the bed frame, bedding and occupants.

The connection points between the side rails and the floor is the inherent weakness of the structure. Sheet metal is by its nature going to have edges and such edges will concentrate force caused by the weight of the bedding and occupants. In time those connections can become unreliable and loosen. Any movement within those connections is libel to cause a squeaking noise, which is recognized in the industry as a defect almost as critical as a collapse.

A further problem with the use of steel for connection points between cross members and side rails of a bed frame is that steel can be expensive and difficult to work with. Too, steel needs to be coated to avoid corrosion.

Accordingly, it would be advantageous to provide connections between cross members and side rails of a bed frame that are comprise of a materials other than steel, such as plastic, and also to provide such connection that do not require tools for the assembly of the bed frame.

SUMMARY OF THE INVENTION

In accordance with the present invention, there is a system to carry out the connection of two structural components of a bed frame, and as one exemplary embodiment, the connection between a cross member and a side rail of a bed frame. The present system is usable with the need for tools in the assembly of the bed frame at the site where the bed is to be used.

The inventive system creates a robust interconnection between a side rail and a cross member of a bed frame, or other bed frame components by employing a wedge on one of the components and a receiver on the other of the components such that there is a three dimensional contact of the wedge into the receiver and thus a greater resistance to bending, swaying or other undesired movement. The user can easily see the wedge fits to the receiver. The fit locks the frame together quickly and securely. The downward pressure of the bedding makes the connection rock solid. Any looseness that might develop is taken away by the automatic and constant resetting of the wedge in the receiver.

The side rails and the cross members are secured together with a tool-less interlock that uses the weight of the supported load to combined the separate parts into one unit. The unit forms the connection between the side rail and cross member and also a support leg. The cross member has the male portion of the connection and the side rail has the female portion of the connection incorporated with the bed frame legs. The assembly utilizes a three dimensional wedge at the ends of the cross member to both connect and stabilize the leg and frame side rails. The wedge has a continuous surface contact with the receiving leg. This unique relationship dissipates the stress on this connection and thereby allows for the use of materials and processes not normally conducive to the task of supporting a mattress set.

The plastic tool-less assembly of the cross member to the side rail is unique in that a downward force is translated to outward forces by means of the angular wedge shape member. The outward force is then constrained by the continuous inner surface of the receiving member. Because the entirety of the wedge is acting on the receiver, this outward force is universally felt and dissipated where one point, line or other surface contact is under greater stress. Because the receiver is a continuous surface entirely surrounding the wedge member, its surface is put in tension and is very stable under the stress. This allows the wedge and the receiver to become integral to each other and resist not only downward pressure but also twisting forces.

These and other features and advantages of the present invention will become more readily apparent during the following detailed description taken in conjunction with the drawings herein.

DETAILED DESCRIPTION OF THE INVENTION

Figure 1:
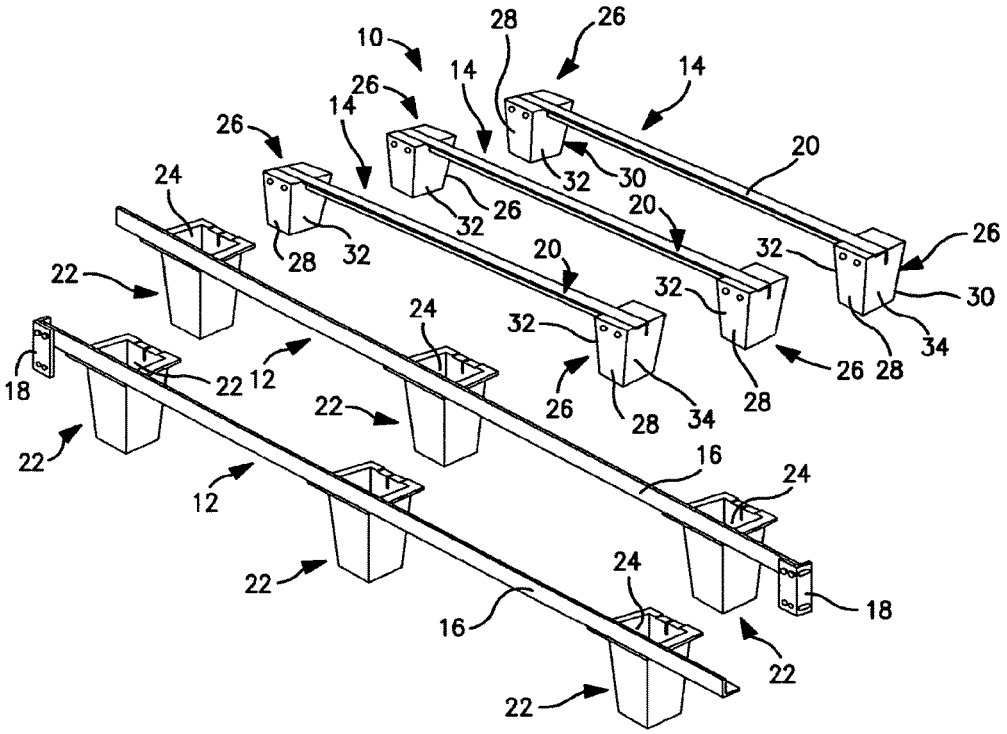
FIG. 1 is a perspective view illustrating the components of a bed frame utilizing the present invention.

Turning first to FIG. 1, there is shown a perspective view illustrating the components of a bed frame 10 utilizing the present invention. As can be seen, the bed frame 10 comprises a pair of side rails 12 and a plurality of cross members 14. As shown, there are three cross members 14, however a lesser or greater number of cross members 14 can be used in constructing a bed frame. The side rails 12 are comprised of L-shaped angle irons 16 and each include an end bracket 18 for affixing thereto, a headboard or a footboard (not shown). The cross members 14 are L-shaped irons 20 that will be later described.

Affixed to each of the side rails 12 are tapered receivers 22 having a female cavity 24 formed therein. The tapered receivers 22 are comprised of molded plastic and the cavities 24 have interior sides tapered inwardly in a manner to be later explained. Affixed to the ends of the cross members 14 are tapered wedges 26 that are tapered in a manner to be later explained. The tapered receivers 22, however, are trapezoidal in shape and thus have four exterior surfaces, that is, two opposite exterior side surfaces 28, 30 and two exterior surfaces 32, 34 generally at oriented 90 degrees to the exterior side surfaces 28, 30.

Figure 2A:
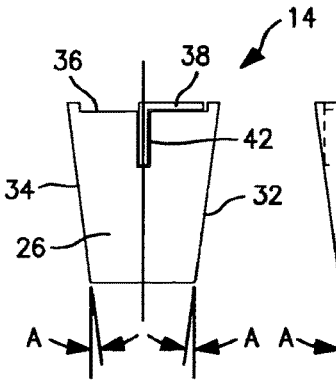
FIGS. 2A and 2B show front and side views, respectively, of a cross member and tapered wedge of the present invention.
Figure 2B:
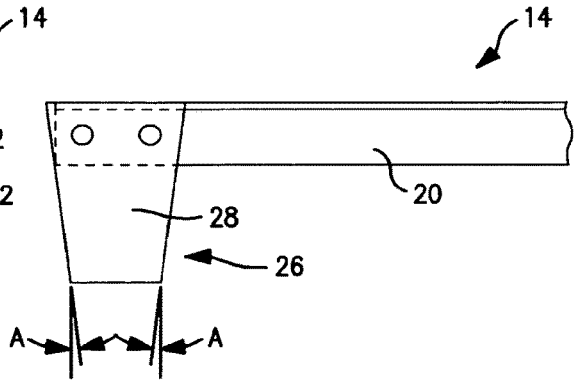
Figure 3:
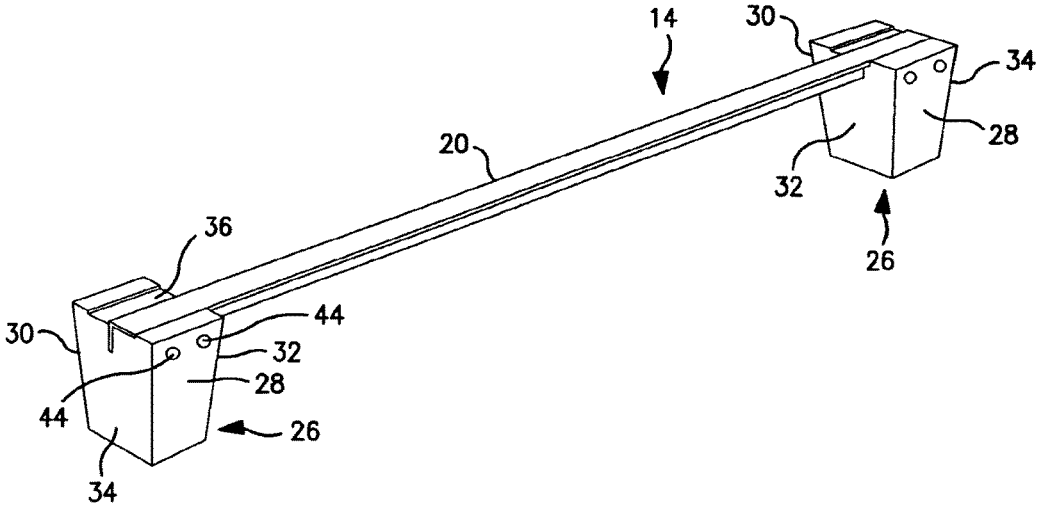
FIG. 3 is a perspective view showing a cross member and tapered wedge assembly.

Turning then to FIGS. 2A, 2B and 3, there is shown, respectively, an end view, a side view and a perspective view of the cross member 14 and including a tapered wedge 26 affixed thereto. As can be seen the exterior surfaces 32, 34 of the tapered wedge 24 taper inwardly in the downward direction, that is, the direction away from the L-shaped angle iron 20. As can also be seen, the exterior side surfaces 28 and 30 also taper inwardly in the same direction i.e. downwardly. The angle A of the taper of any of the exterior surfaces 28, 30, 32 and 34 may vary but in the exemplary embodiment that angle is about 15 degrees with respect to the vertical.

There is a recessed area 36 formed at the top of the tapered wedge 26 to allow the horizontal flange 38 of the L-shaped angle iron 20 to be received therein. A slot 40 is formed in the top of the tapered wedges 26 in order to receive the vertical flange 42 of the L-shaped angle iron 20. Suitable devices can be used to rigidly affix the cross member 14 to the tapered wedge 26 and those devices can include rivets 44.

Figure 4A:
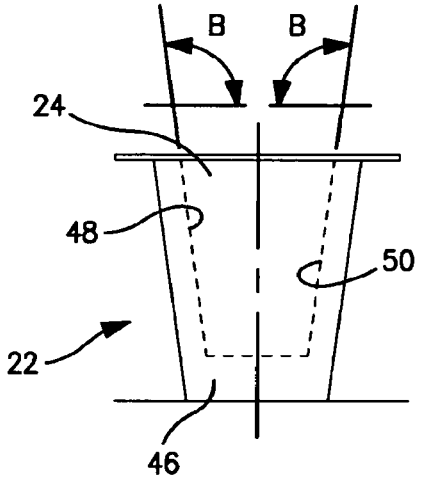
FIGS. 4A and 4B are front and side views of a tapered receiver adapted to be affixed to a side rail of a bed frame.
Figure 4B:
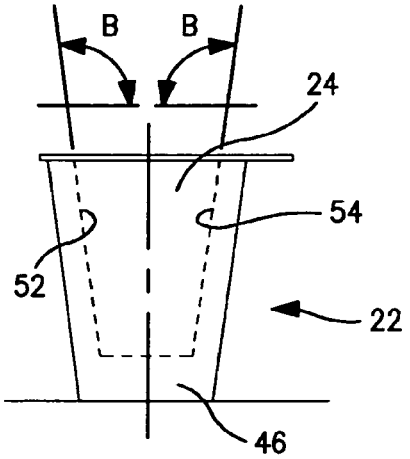
Figure 5:
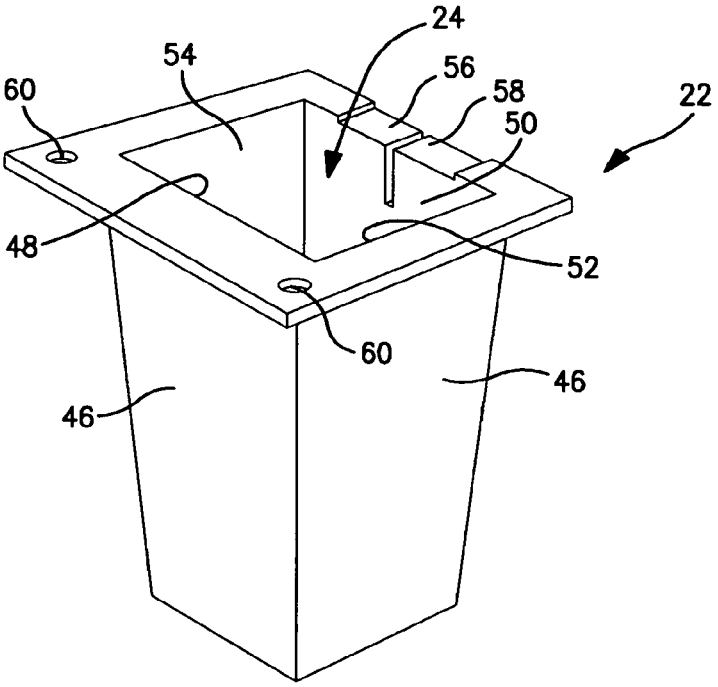
FIG. 5 is a perspective view showing a tapered receiver adapted to be affixed to a side rail of a bed frame.

Turning now to FIGS. 4A, 4B and 5, there is shown, respectively, a front view, side view and perspective view of a tapered receiver 22 used with the present invention. As can be seen the tapered receiver 22 has outer surfaces 46 with the female cavity 24 having interior side surfaces 48, 50 as well as interior surfaces 52, 54. Again, the interior surfaces 52, 54 of the tapered receiver 22 taper inwardly in the downward direction, that is, the direction away from the L-shaped angle iron 16 (FIG. 1). As can also be seen, the interior side surfaces 50 and 52 also taper inwardly in the same direction i.e. downwardly. The angle B of the taper of any of the interior surfaces 48, 50, 52 and 54 may vary but in the exemplary embodiment that angle is about 105 degrees with respect to the horizontal. There is a recessed area 56 for receiving a horizontal flange (FIG. 1) of the cross member 14 and a slot 58 for receiving the vertical flange 42 of the cross member 14 (FIG. 1). There are also two holes 60 for fastening the tapered receiver 22 to a side rail 12 and, again, rivets may be used to carry out that affixation.

In the embodiment shown in FIG. 5, the recessed area 56 and slot 58 are oriented so as to receive either an L-shaped cross member 14 or a T-shaped cross member having its vertical flange located about midway between the ends of its horizontal flange.

Figure 6:
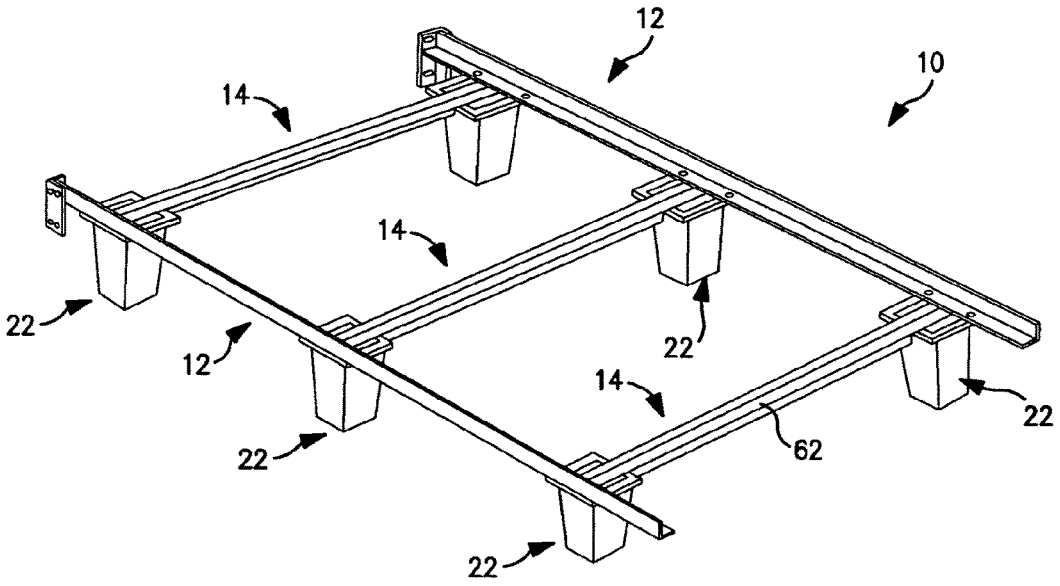
FIG. 6 is a perspective view showing an assembled bed frame with standard angle side rails and connection constructed in accordance with the present invention.
Figure 7:
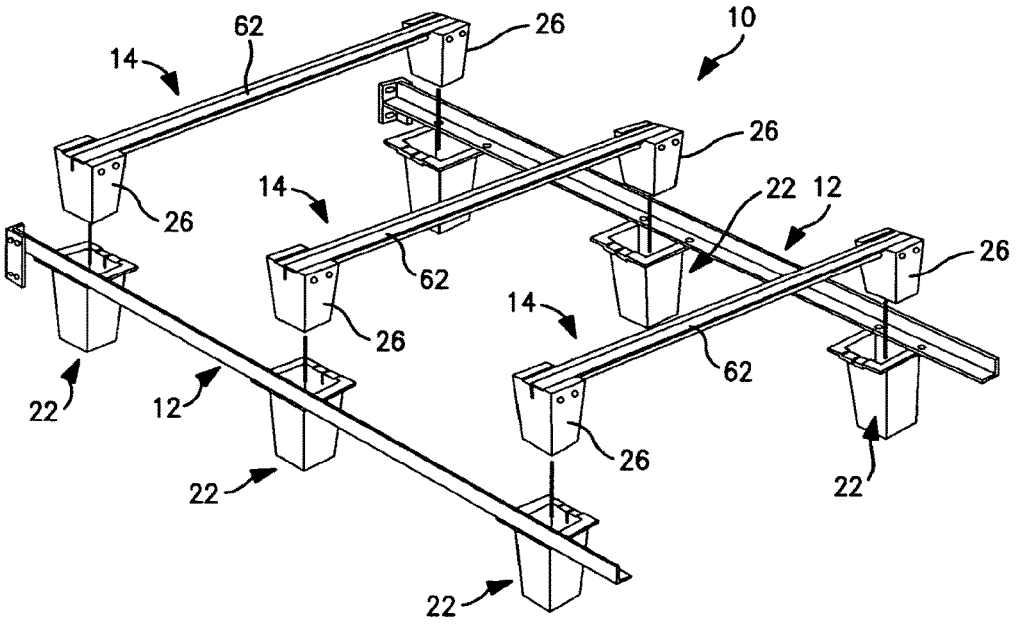
FIG. 7 is an exploded view illustrating the assembly of a bed frame utilizing the connection of the present invention.

Turning then to FIGS. 6 and 7, there is shown, respectively, a perspective view and an exploded view, of a bed frame 10 and illustrating the three dimensional connection of the present invention wherein the cross members 14 have T-shaped elongated members 62 that may be constructed of two L-shaped members affixed together or a unitary T-shaped metal member.

Figure 8:
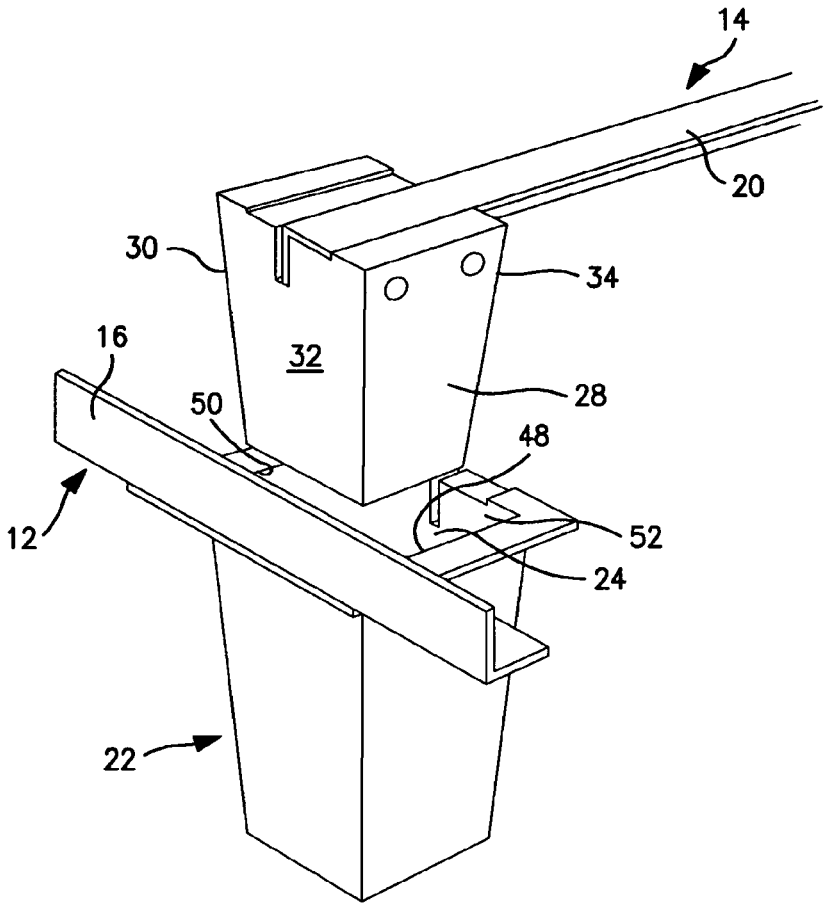
FIG. 8 is an exploded view illustrating the connection of a cross member to a side rail of a bed frame.

Turning next to FIG. 8, taken along with FIGS. 1-7, there is shown an exploded view of the connection of a cross member 14 with a side rail 12 and, as can be seen, the exterior side surfaces 28 and 30 and the exterior surfaces 32, 34 interfit into the female cavity 24 by mating with the interior side surfaces 48, 50 and interior surfaces 52, 54 of the tapered receiver 22. As such, the interfitting results in a solid connection between two molded plastic components. In the exemplary embodiment, all four of the exterior surfaces of the wedges are tapered and all four of the interior surfaces of the female cavity 24 of the receivers 22 are also tapered, it being seen that the connection could be made with the present invention with two or more of the mating surfaces being tapered.

Figure 9A:
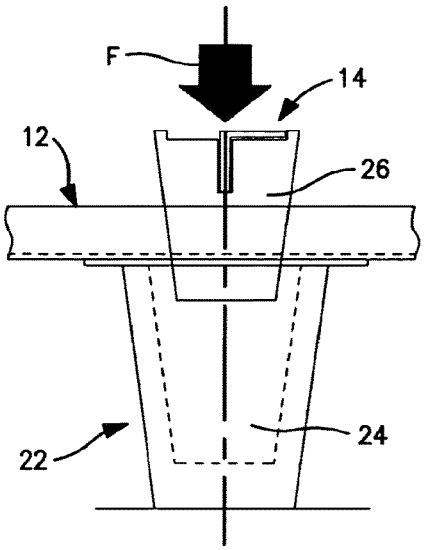
FIGS. 9A and 9B are schematic views showing the matching tapers of the cross rail wedge and a tapered receiver.
Figure 9B:
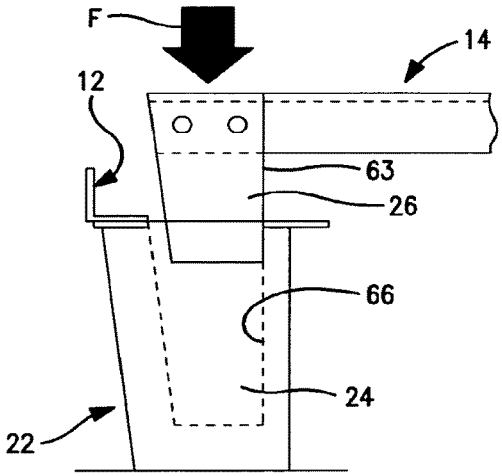

Next, in FIGS. 9A and 9B, there is a schematic view illustrating a connection being made between a cross member 14 and a side rail 12 with a force pushing the wedge 26 into the receiver 22 in the direction of the arrow F. In this embodiment, the exterior side surface 63 of the tapered wedge 26 is not tapered, that is, it is vertical as well as the corresponding interior surface 66 of the female cavity 24 of the receiver 22. As such it can be seen that only three of the exterior surfaces of the wedge 26 and three interior surfaces of the female cavity 24 are tapered as previously described.

Figure 10A:
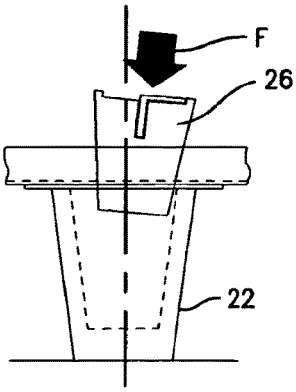
FIGS. 10A-10C are schematic views illustrating the self alignment of a cross rail wedge being inserted into a tapered receiver.
Figure 10B:
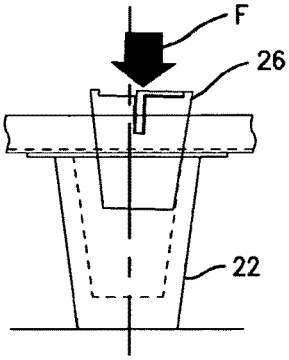
Figure 10C:
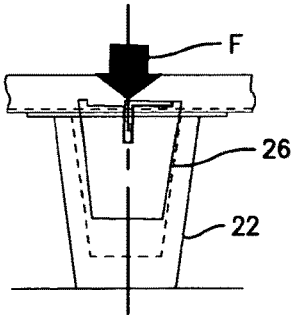

Turning now to FIGS. 10A-10C, there is shown schematic views illustrating the entry of a wedge 26 into the female cavity 24 of a receiver 22 in order to show the self-aligning feature of the present invention. As can be seen, in FIG. 10A, the wedge 26 is entering slightly crooked and its centerline is not aligned with the centerline of the receiver 22, however, the wedge 26 becomes aligned as it continues to enter by a force in the direction of the arrow F into the receiver 22 as shown in FIGS. 10B and 10C. As such, by the use of the three dimensional connection, the cross member 14 automatically and firmly aligns itself with the side rail 12.

Figure 11A:
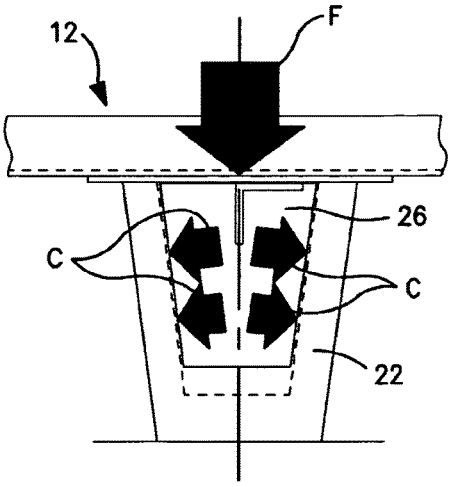
FIGS. 11A and 11B are front and side schematic views showing how downward force on cross rail wedges are transferred to tapered receivers to cause a tighter connection as more weight is applied.
Figure 11B:
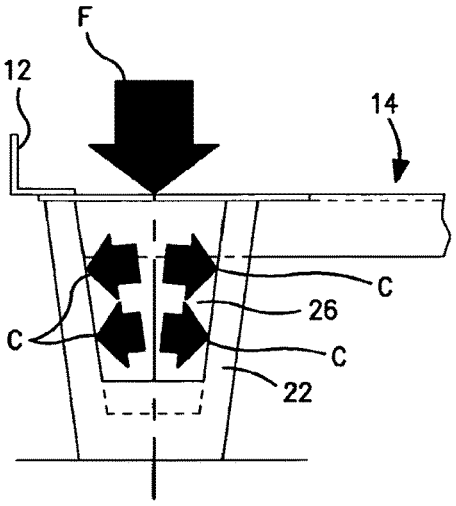
Figure 12:
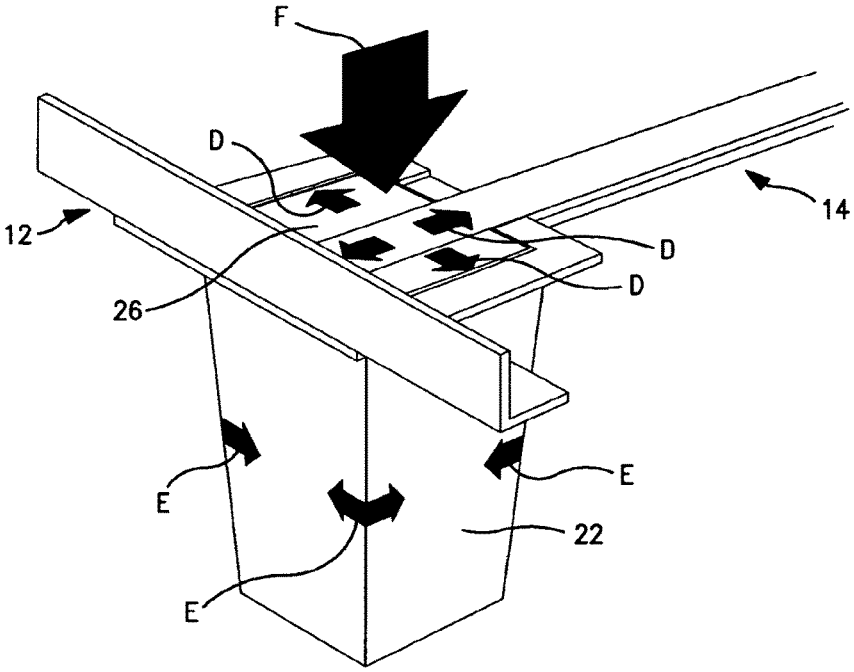
FIG. 12 is a perspective view showing a downward force on a cross member and side rail connection and illustrating how that force is dissipated.

In FIGS. 11A, 11B and 12, there are schematic views illustrating the forces on the connection between a wedge 26 and a receiver 22 such that the downward force, shown by the arrows F translate into the outwardly directed forces C in FIGS. 11A and 11B, and the outward forces as shown in FIG. 12 by the arrows E. In FIG. 12, it can also be seen that the hoop strength, illustrated by arrows H resist the forces imposed on the receiver 22.

Figure 13:
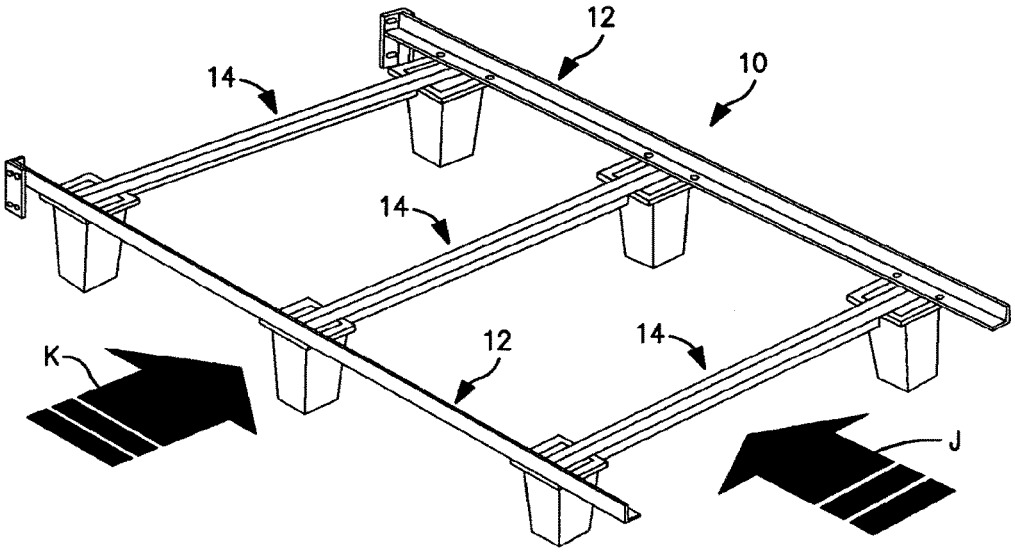
FIG. 13 is a perspective view of assembled bed frame using the present invention and illustrating how side to side forces or front to back forces are applied to a bed frame.

Turning to FIG. 13, there is shown a schematic view of a bed frame 10 using the three dimensional connection between the cross members 14 and the side rails 12 in accordance with the present invention and illustrating the present of a fore and aft force shown by the arrow J and a side to side force illustrated by the arrow K. In each instance, the bed frame 10 does not collapse due to the resistance to those forces by the three dimensional connections between the cross members 14 and the side rails 12 of the present invention.

Figure 14:
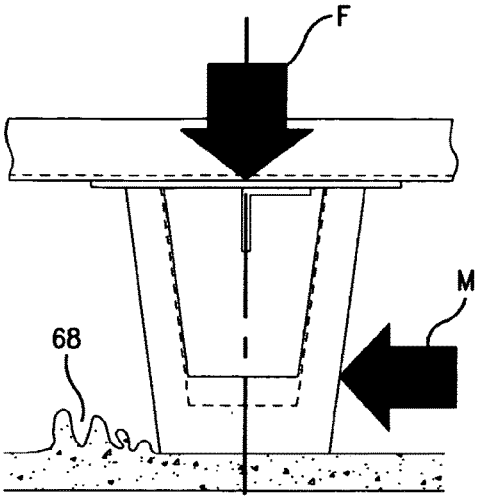
FIG. 14 is a schematic view illustrating the influence of both downward force and front to back force when a bed frame having a connection of the present invention is resting on a carpeted floor.
Figure 15:
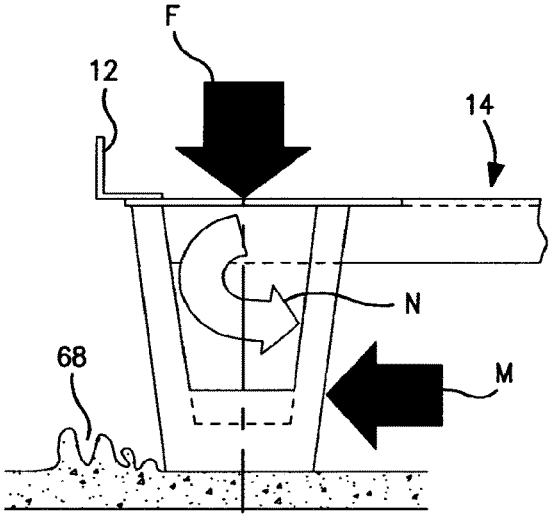
FIG. 15 is a schematic view illustrating a side to side force on a carpet.
Figure 16:
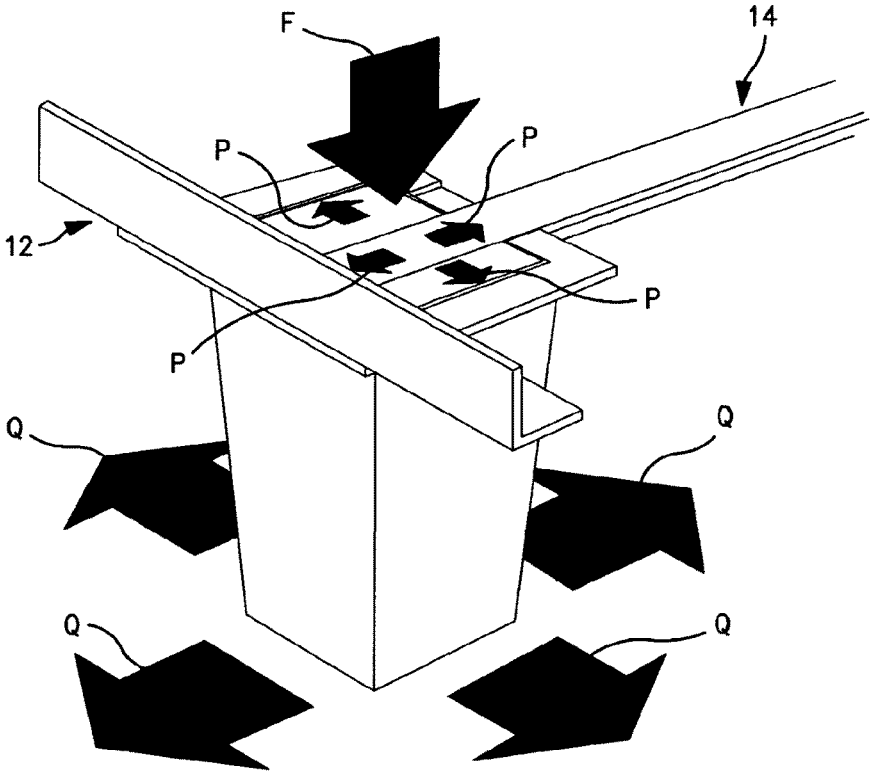
FIG. 16 is a perspective view showing both a downward force on the connection assembly and side to side forces acting on the bed frame.

Turning next to FIGS. 14, 15 and 16, there is shown a schematic view of the various forces that can be imposed on the connection between a side rail 12 and a cross member 14 constructed in accordance with the present invention. In each instance there is a downward force on the connection shown by the arrow F. In FIG. 14 there is a side force M and which may pinch the carpet 68 but that force is resisted by the particular connection. As such, the receiver 22 does not loosen or deform under the forces illustrated. The same is true in FIG. 15 where there is a twisting force N that is again resisted by the three dimensional connection between the cross member 14 and the side rail 12. In FIG. 14 the load force F results in side forces P and larger force on the floor in the direction of arrows Q.

Figure 17:
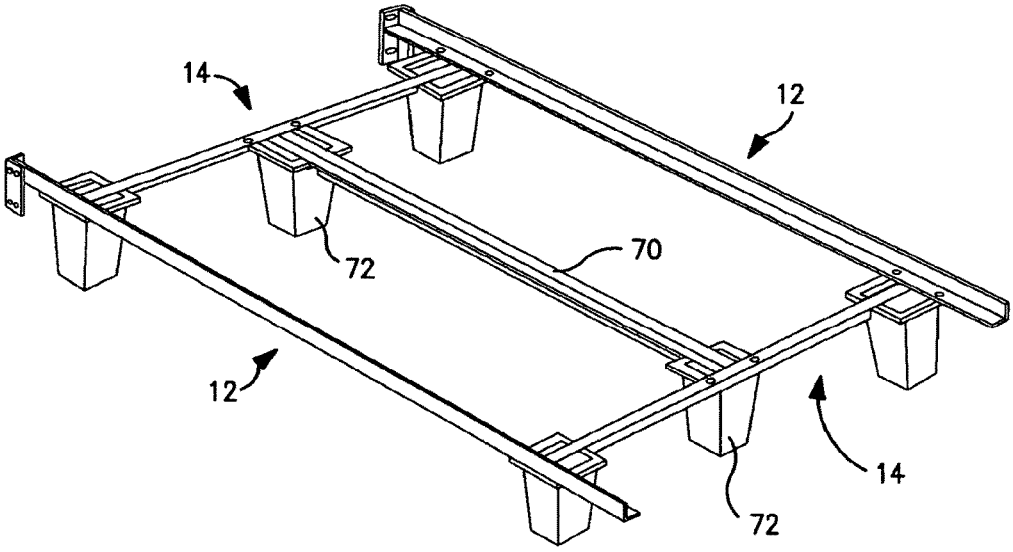
FIG. 17 is a perspective view of a further exemplary embodiment of the present invention showing the connections of the present invention in a different configuration of bed frame with standard angle iron side rails, standard angle iron cross members and a T section front to back center support.
Figure 18:
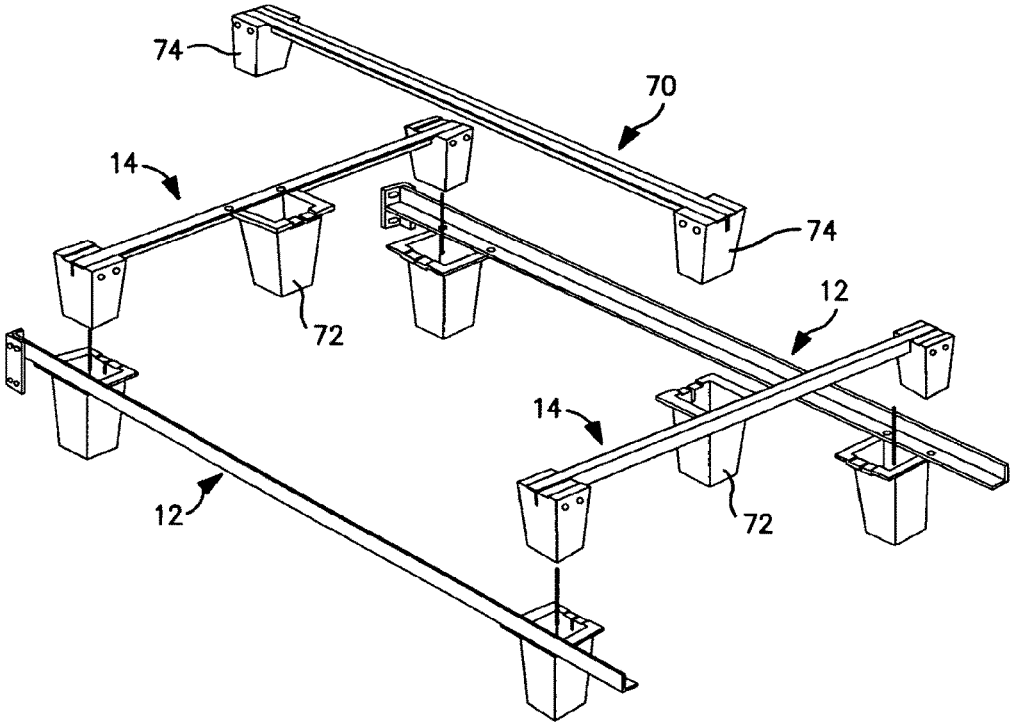
FIG. 18 is an exploded view illustrating the connections of the bed frame of FIG. 17.

Turning next to FIGS. 17 and 18, there is shown, respectively, a perspective view and an exploded view of a further exemplary embodiment of the present invention and wherein there is a center member 70 oriented head to toe. Accordingly, in this exemplary embodiment, there is a receiver 72 affixed generally centrally in each of the cross members 14 and the center member 70 has wedges 74 that interfit into the receivers 72 in the manner preciously described. As such the three dimensional connections of the present invention are present on the bed frame 12 of this embodiment for both connecting the cross members 14 to the side rails 12 but also to connect the center member 70 to the cross members 14.

Figure 19:
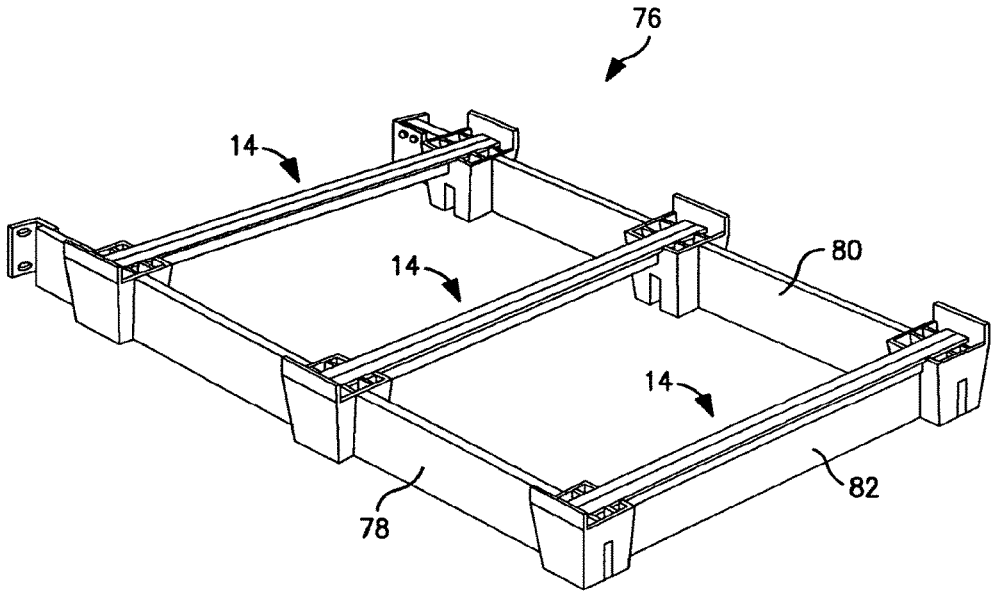
FIG. 19 is a perspective view of another embodiment of a bed frame using the present invention and illustrating an assembled view of a hotel bed with multiple tapered receivers and wedges.
Figure 20:
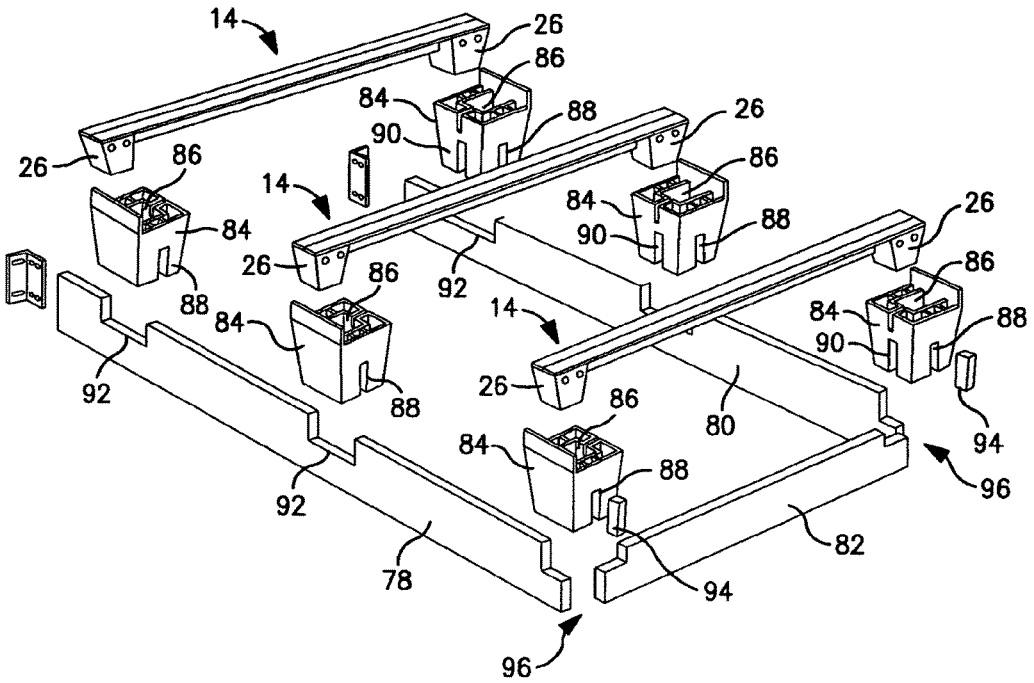
FIG. 20 is an exploded view showing the connections of the bed frame of FIG. 19.

Turning now to FIGS. 19 and 20, there is shown, respectively, a perspective view and an exploded view of a hotel type of bed frame 76 where there are wooden or ¾" Melamine panels instead of the metal elongated side rails 12 of FIG. 1. In this embodiment, there are side panels 78, 80 and a foot panel 82 that basically sit on the floor and support the bed. Again there are three cross members 14 use with this embodiment and each of which have wedges 26 located at the ends thereof. In this embodiment, the receivers 84 are molded plastic and each has an internal female cavity 86 having corresponding interior tapered surfaces corresponding to the tapered exterior surfaces of the wedges 26, thereby providing three dimensional connections as previously explained.

With the hotel type of frame 76, however, each receiver 84 has a through slot 88 and a blind slot 90 formed therein to fit with the side panels 78 and foot panel 82 that fit up into the slots 88, 90. The through slots 88 interfit with the notches 92 formed in the side panels 78, 80 and the blind slots 90 interfit with the foot panel 82. There are filler plugs 94 located at the corners 96 that fill in the unused portions of the through slots 88 so that the receivers 84 can be produced uniformly and used in any of the desired locations.

Figure 21:
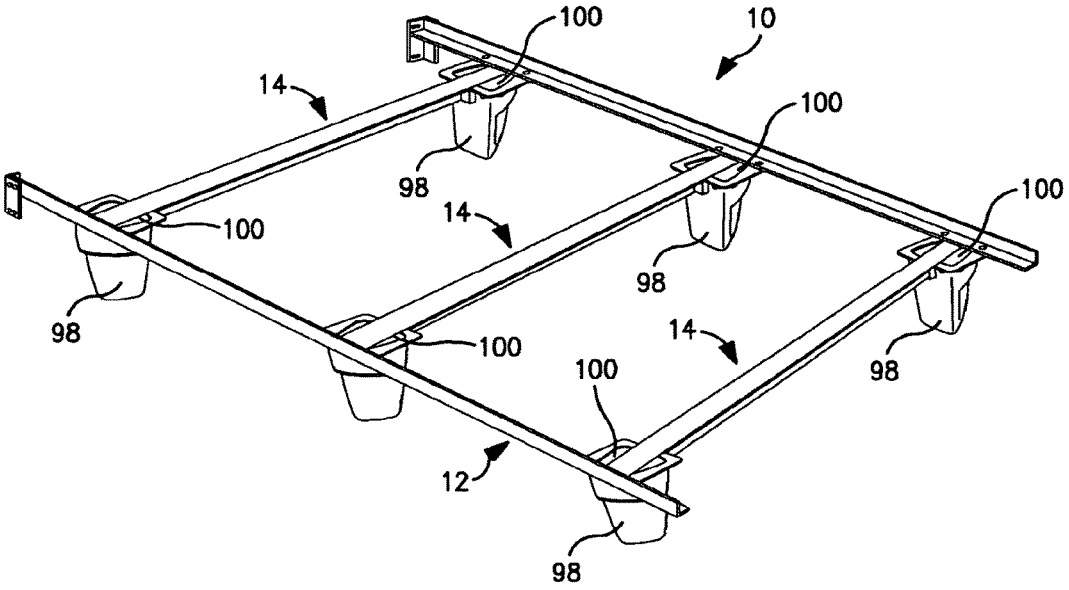
FIG. 21 is a perspective view of a further exemplary embodiment showing an assembled bed frame with the exemplary molded housings.

In FIG. 21, there is a perspective view of a further exemplary embodiment wherein the external surfaces of the receiver 98 are rounded to provide a better appearance of the furniture. Again, the bed frame 10 includes two side rails 12 and three cross members 14 to make up the overall bed frame 10 such that there are six receivers 98 and six wedges 100.

Figure 22:
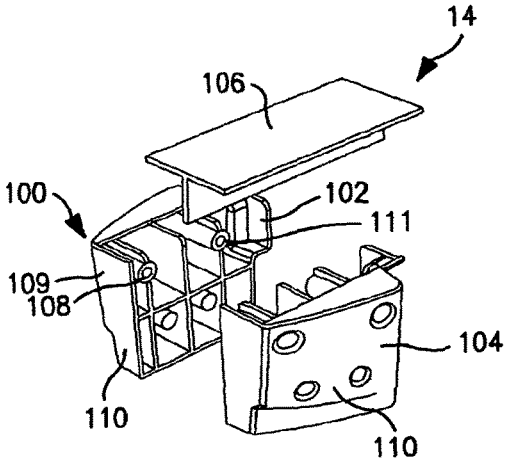
FIG. 22 is an exploded view of a tapered wedge of the FIG. 21 embodiment.
Figure 23:
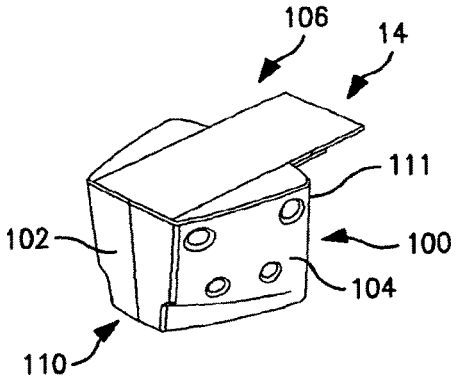
FIG. 23 is a perspective view illustrating an assembled tapered wedge of the FIG. 21 embodiment affixed to a steel T section cross member.
Figure 24:
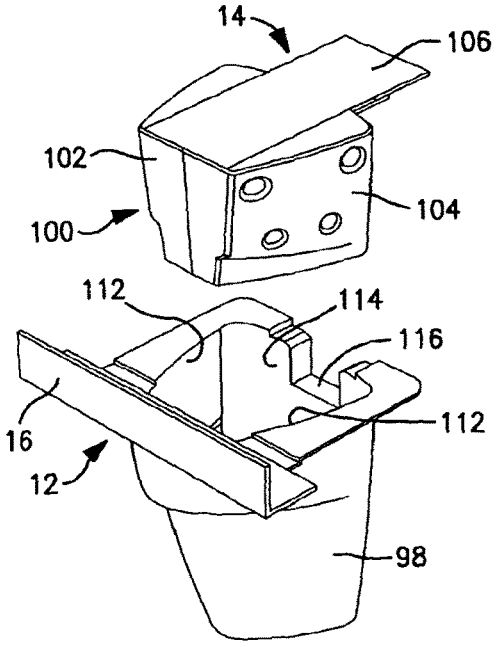
FIG. 24 is an exploded view illustrating an assembled tapered wedge and tapered receiver of the FIG. 21 embodiment.
Figure 25:
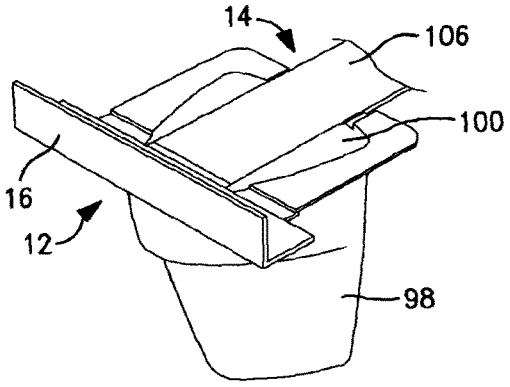
FIG. 25 is a perspective view illustrating a connection between a cross rail and side rail using the FIG. 21 embodiment.

The FIG. 21 receivers 98 and wedges 100 are shown in FIGS. 22-24 where FIG. 22 is an exploded view of a wedge 100, FIG. 23 is a perspective view of a wedge, FIG. 24 is an exploded view of the interfitting of a wedge 100 into a receiver 98 and FIG. 25 is a perspective view of the completed connection between the wedge 100 and a receiver 98.

As can be seen in FIG. 22, wedge 100 is comprised to two wedge sections 102, 104 that are affixed together sandwiching the T-shaped elongated iron member 106 therebetween. The wedge section 102 can have bosses 108 molded therein for rivets (not shown) to pass between the two wedge sections 102, 104 to secure them together and to retain the T-shaped iron member 106 thereto. The side surfaces 109, 110 of the wedge section 102 and 104 are tapered inwardly in the downward direction, that is, away from the T-shaped cross member 106 whereas the end surface 111 and the inside surface 110 can be vertically oriented. In FIG. 23, the completed wedge 100 is shown affixed to the end of the iron member 106.

In FIG. 24, there is shown the impending connection between the wedge 100 and the receiver 98 and, as can be seen, the interior side surfaces 112 are tapered downwardly and also may be tapered inwardly in the direction toward the side rail 12. As such, the receiver 98 takes on a streamlined, pleasing appearance. The interior surface 114 can be vertically oriented so as to mate with the vertically oriented end surface 111 of the wedge 100. Again, the receiver 98 is affixed to the L-shaped angle iron 16 of the side rail 12 and there is a notch 116 formed in the receiver 98 for the downward flange of the T-shaped iron member 106.

FIG. 25 shows a completed connection between the wedge 100 and the receiver 98 and the can be seen the tapering of the wedge toward the L-shaped angle iron 16 for an enhanced appearance.

Figure 26:
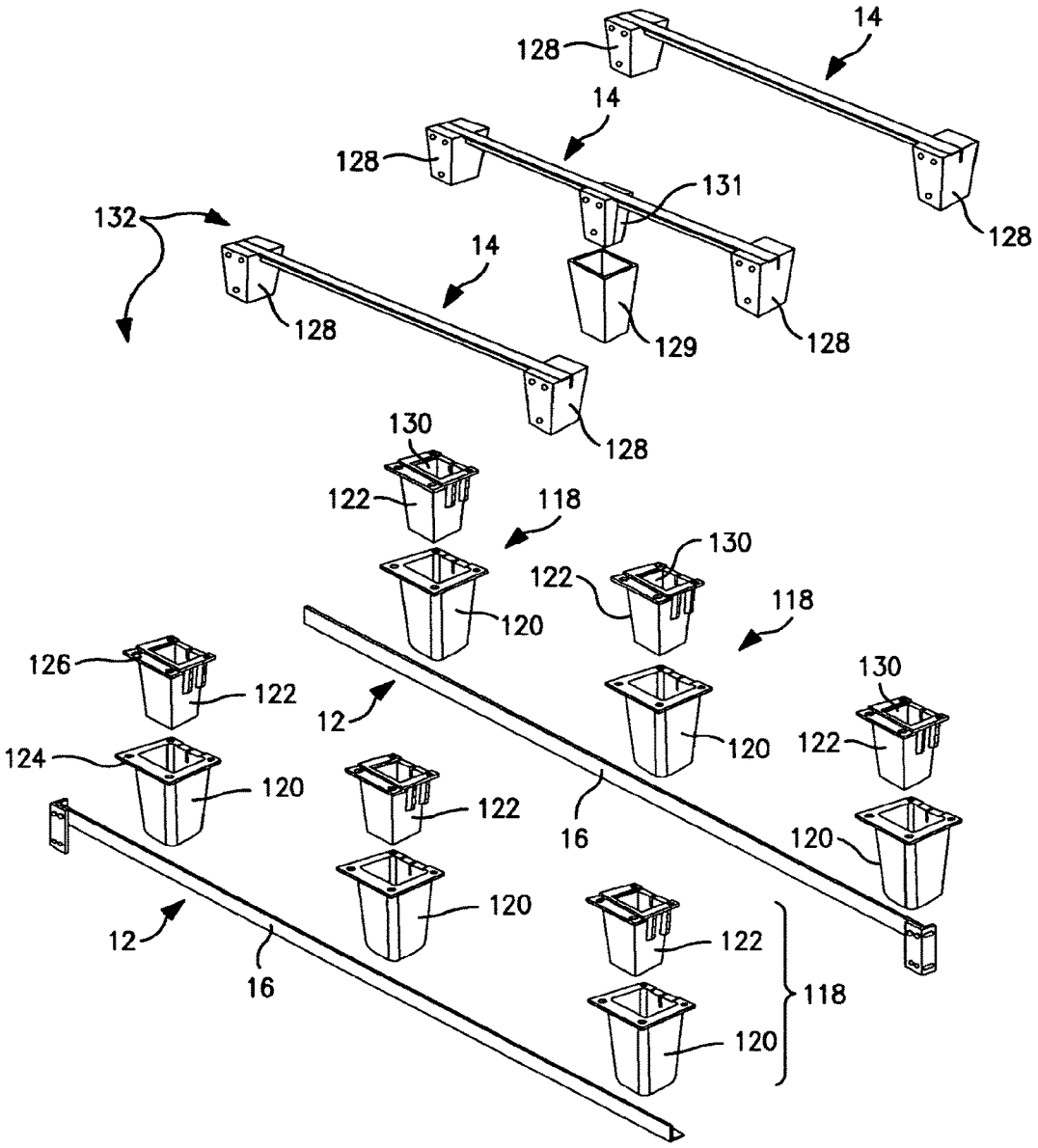
FIG. 26 shows all of the components that are used to construct a bed frame having three dimensional connections with a optimized leg and wedge assembly, two side rail assemblies and three cross rail assemblies.

Turning next to FIG. 26, there is shown a further exemplary embodiment of the present invention wherein the receiver 118 is comprised of two components, that is, a lower leg section 120 and an insert section 122 which are, again affixed to the angle iron 16 of the side rail 12 via rivets (not shown) passing through openings 124 and 126, respectively in the lower leg section 120 and the insert section 122. As before, there is a wedge 128 affixed to the cross members 14 that interfits into the receivers 118 to carry out the connection of the cross members 14 with the side rails 12. There is also a leg 129 the is simply attached to the bottom of the middle wedge 131 if the cross member 128.

As such, the lower leg section 120 surrounds the insert section 122 and can be designed to have a smooth and rounded for visual appearance of finished furniture and to make it more comfortable if contacted by bare feet. The insert section 122 of the receiver 118 assembly is shaped to receive the wedge 128 and in this way has a cavity 130 that is designed to be the corresponding shape related to the wedge 128.

The wedge 128 itself is not, by its nature, a smooth rounded shape since it is preferred that the wedge 128 and insert section 122 have edges and corners and corresponding grooves to key the parts together so as to create a secure junction of the side rail 12 to the cross member 14. The user can easily see the wedge 128 fits into the receiver 118. The interfit between the wedge 128 and the receiver 118 locks the bed frame 132 together quickly and securely and the downward pressure of the bedding makes the connection rock solid. Any looseness that might develop is taken away by the automatic and constant resetting of the wedge 128 in the receiver 118 as with the one piece leg described before. The two component receiver 118 allows the connection with the wedge 128 to be a different shape than the receiver 118 itself and this is beneficial to the look of the furniture.

Figure 27A:
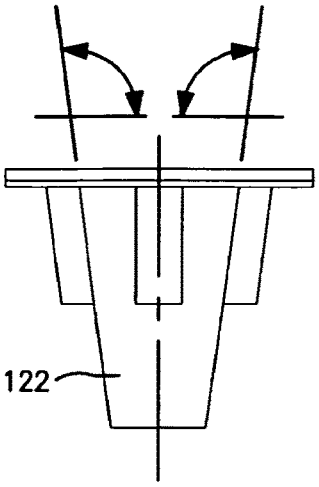
FIG. 27A and 27B show, respectively, front and side views showing a tapered wedge receiver found on the inner part of the two part leg assembly.
Figure 27B:
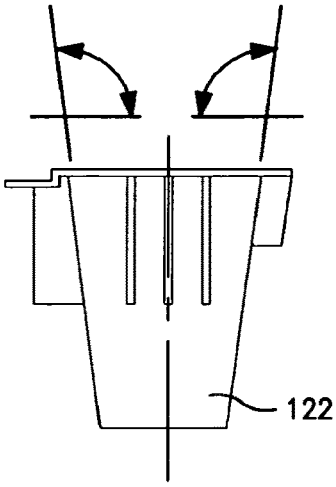
Figure 28:
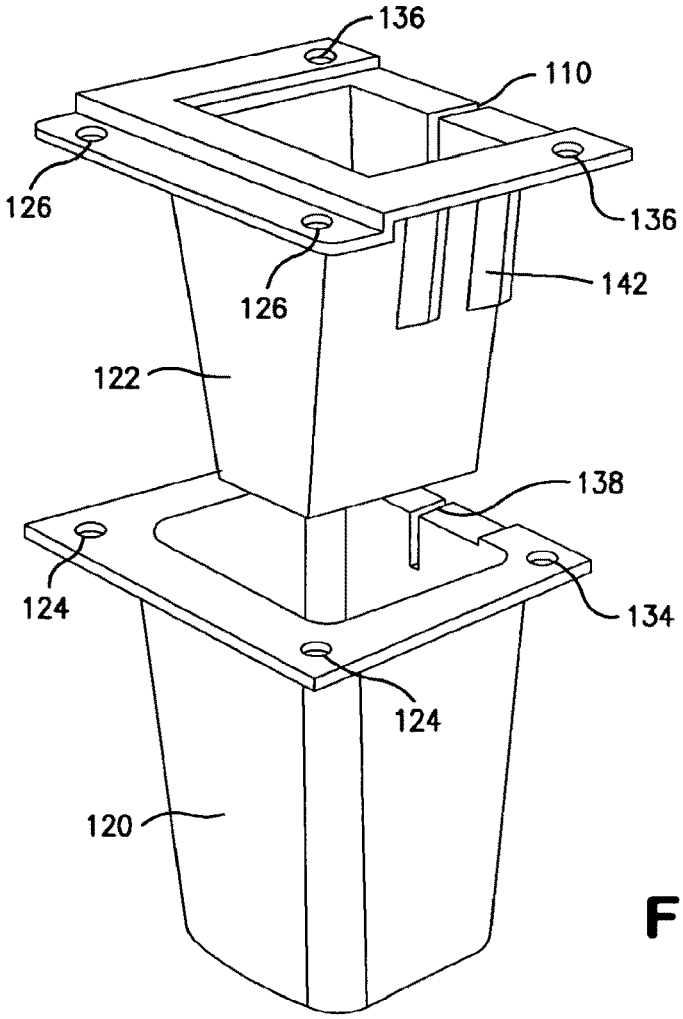
FIG. 28 is a perspective view showing a contoured outer leg and inner tapered receiver with attachment holes.

Turning then to FIG. 27A, 27B and 28, taken along with FIG. 26, there is shown, respectively, an end view, a side view and an exploded view of the two piece receiver 118 of FIG. 26. As such, the holes 124 and 126 can be seen that are used to affix the receiver 118 to the side rail 12 as well as affix the lower leg section 120 to the insert section 122. There are also additional holes 134 and 136, respectively, in the lower leg section 120 and the insert section 122 to assist in affixing those components together and in each instance, suitable devices can be used such as rivets (not shown).

Again the lower leg section 120 has a slot 138 for receiving a downward extending flange of the cross member 14 and a corresponding slot 140 in the insert section 122. There are also a plurality of protrusions 142 to assist in the interfitting of the insert section 122 into the lower leg section 120. The protrusions 142 can be provided on all four sides of the insert section 122 or, alternatively, there may similar protrusions extending outwardly from the interior surface of the lower leg section 120 to aid in seating the insert section 122 and the lower leg section 120.

Figure 29:
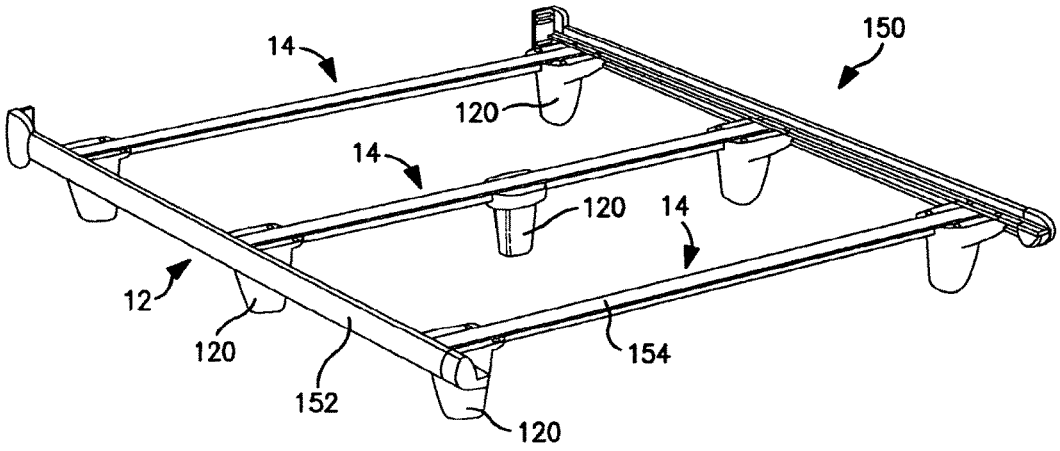
FIG. 29 is a perspective view showing the assembled three dimensional connection of a bed frame with double angle side rails and three T section side to side cross members.

Turning to FIG. 29, there is a perspective view of a bed frame 150 having plastic casings covering the components of the bed frame 150 while using the three dimensional connection system of the present invention. As such the present connection system can be used while including side rail plastic casings 152 and cross member plastic casings 154.

Figure 30:
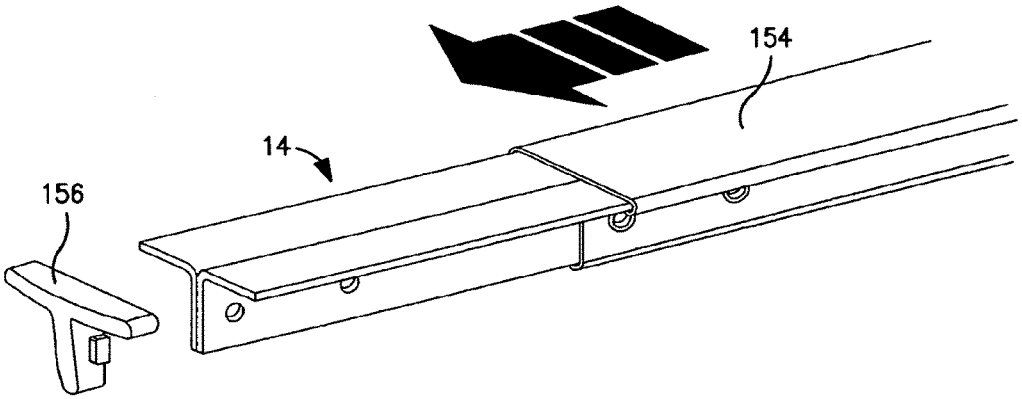
FIG. 30 is an exploded view of a steel T section cross member fully encased in a plastic extrusion and end cap.

In FIG. 30, there is an exploded view of a cross member plastic casing 154 with an end cap 156 affixed to the end of the cross member.

Figure 31:
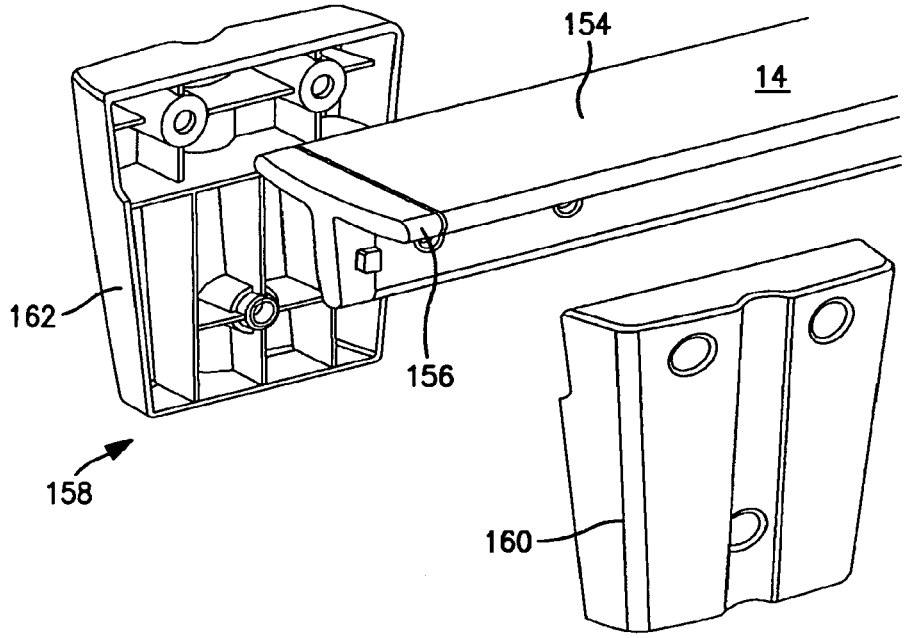
FIG. 31 is an exploded view showing the assembly of the steel T section cross members to the two part tapered wedge.
Figure 32:
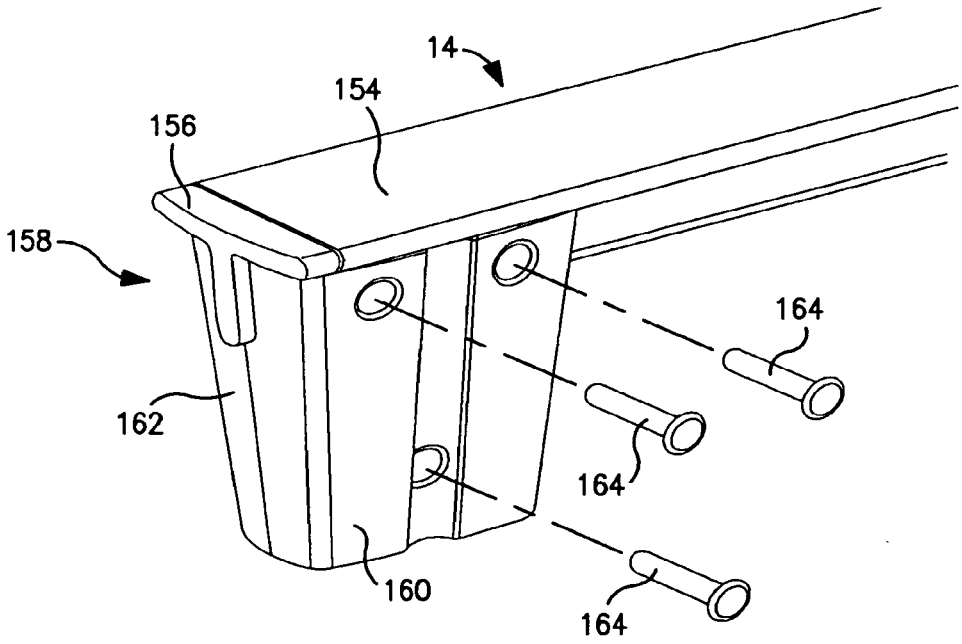
FIG. 32 is an exploded view showing the assembly of the steel T section cross members where the two part tapered wedge has an end cap and is completely encased in plastic casings.
Figure 33:
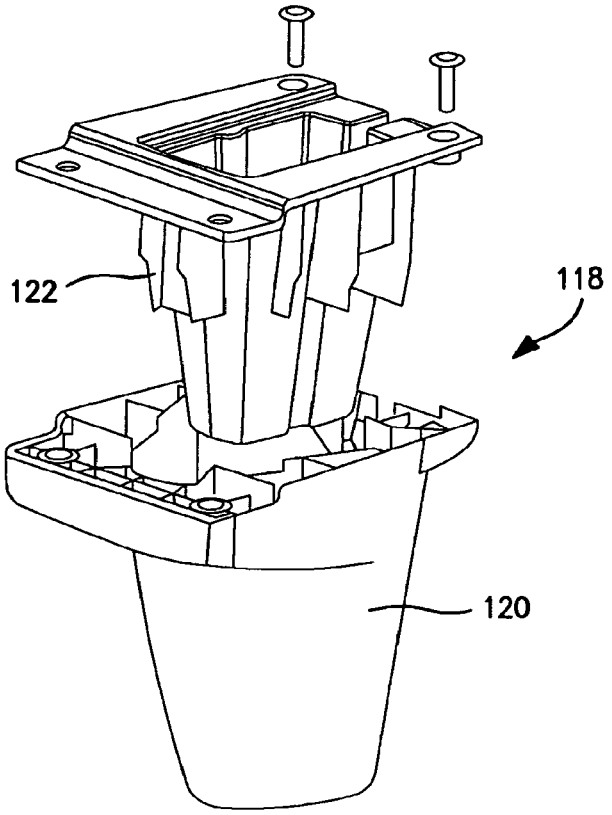
FIG. 33 is an exploded view showing an exemplary embodiment of a a two piece receiver of the present invention.
Figure 34:
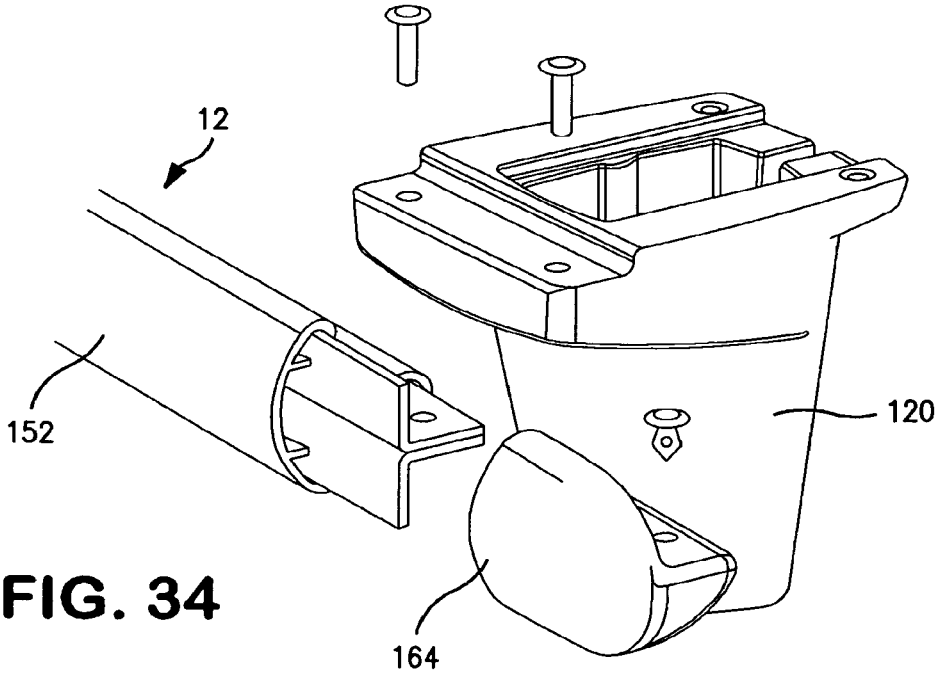
FIG. 34 is an exploded view of the receiver of FIG. 33 being affixed to a side rail.
Figure 35:
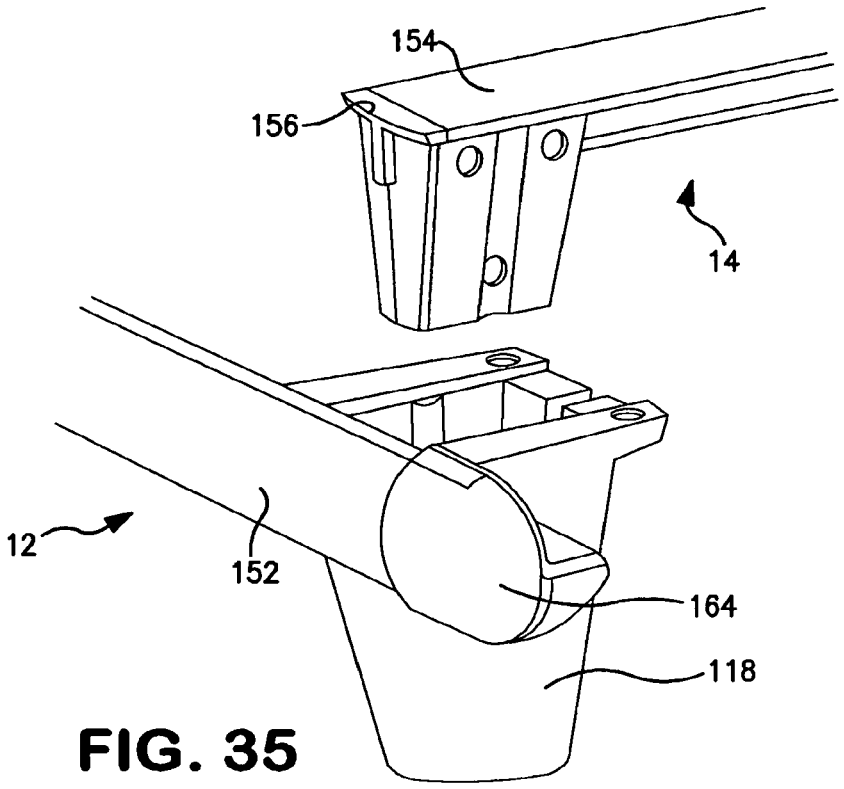
FIG. 35 is an exploded view of the connection of a wedge into the receiver of FIG. 33 affixed to a side rail.
Figure 36:
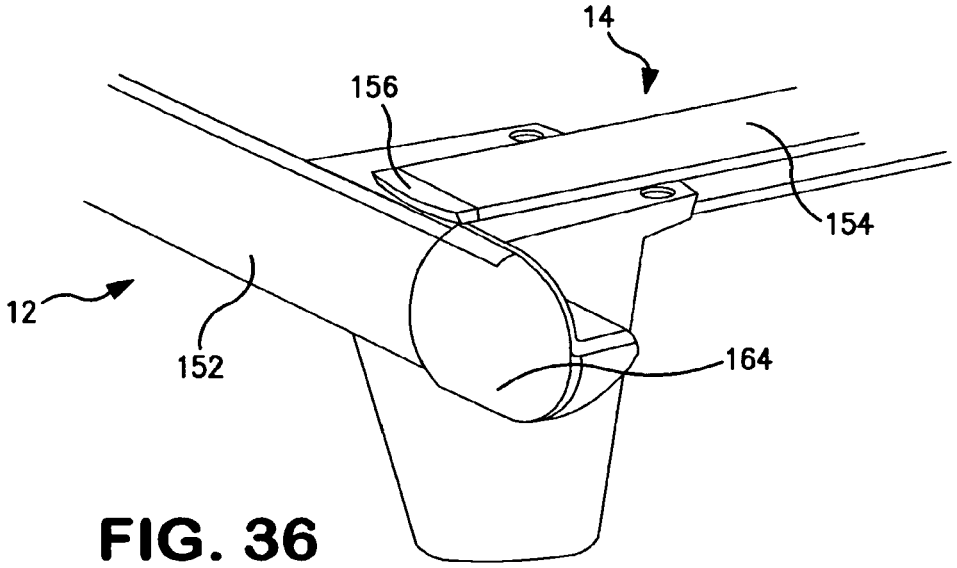
FIG. 36 is a perspective view showing a connection between a cross member and a side rail in accordance with the present invention with the components encased in plastic casings.

FIGS. 31 and 32 are, respectively, an exploded view and a perspective view of a wedge 158 comprising two wedge sections 160, 162 that affixed together, by means of rivets 164 to become affixed to a cross member 14 having a cross rail plastic casing 154 with an end cap 156.

In FIGS. 33, 34, 35 and 36, there is shown an exploded view of a receiver 118, an exploded view of a receiver and a side rail 12, an exploded view of the connection of a cross member 14 to the side rail 12 and a perspective view of a completed connection between a cross member 14 and a side rail 12 where all of the bed frame components are covered by plastic casings. As such the cross member 14 includes a cross member plastic casing 154 and end cap 156 and the side rail 12 includes a side rail plastic casing 154 and an end cap 164.

Figure 37:
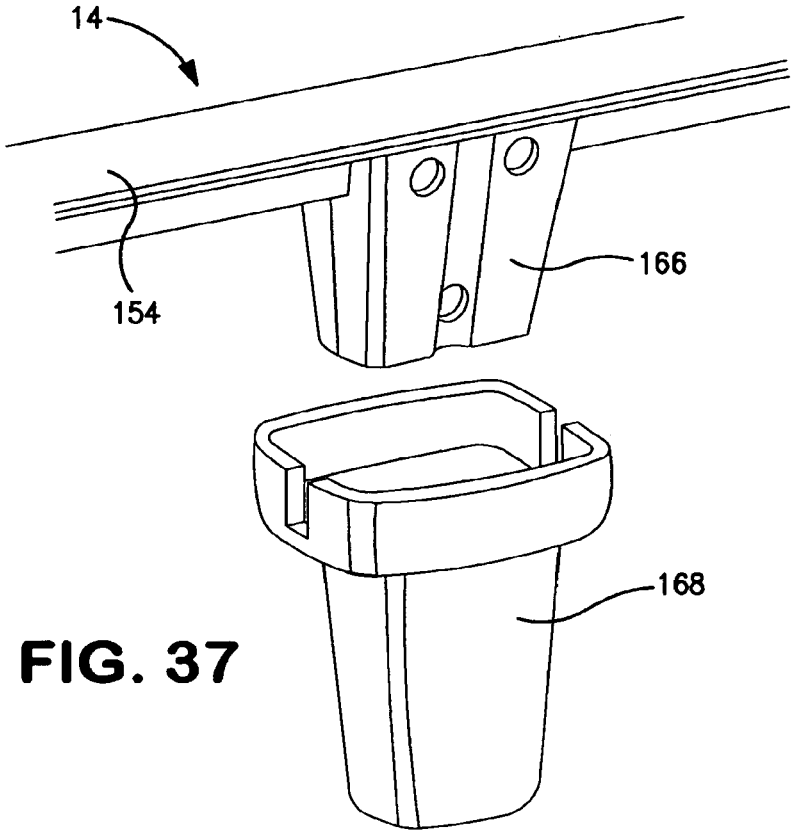
FIG. 37 is an exploded view showing an exemplary embodiment wherein a wedge is being interfitted into a center leg of a cross member.
Figure 38:
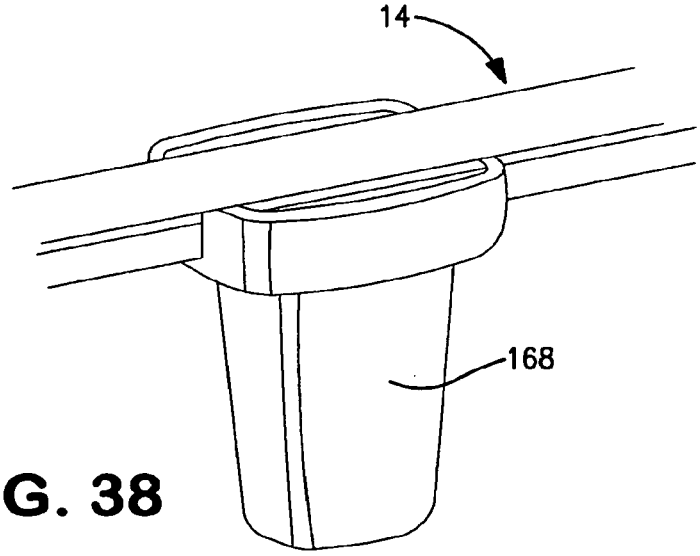
FIG. 38 is a perspective view of the completion of the assembly of the FIG. 37 embodiment.

Finally, FIGS. 37 and 38 are, respectively, an exploded view and a perspective view showing a cross member 14 with a wedge 166 interfitting with a receiver 168 where the cross member 14 has a cross member plastic casing 154 affixed thereto.

While the present invention has been set forth in terms of a specific embodiment of embodiments, it will be understood that the present three dimensional connection system for a bed frame herein disclosed may be modified or altered by those skilled in the art to other configurations. Accordingly, the invention is to be broadly construed and limited only by the scope and spirit of the claims appended hereto.

What is claimed is:

1. A bed frame assembly positioned on a floor for supporting a mattress or mattress set, the bed frame assembly comprising side rails and at least one cross member, each side rail having least two receiving legs affixed to the ends of said side rails adapted to contact the floor, each receiving leg having an interior cavity with a plurality of inner surfaces, at least two of the inner surfaces being tapered inwardly in the downward direction, the at least one cross member comprised of a metal structural component having opposed ends and having plastic wedges at each of the opposed ends, each plastic wedge having an upper surface wherein the metal structural component extends at least substantially across the upper surface of each plastic wedge, each plastic wedge further having a plurality of exterior side surfaces wherein in at least two of the exterior side surfaces are tapered inwardly in the downward direction so as to complementarily interfit with the interior cavity of the receiving legs to connect the at least one cross member to a side rail forming a surface contact between the plastic wedge and the receiving leg, each receiving leg consisting essentially of:

a lower leg section that makes direct contact with said floor, said lower leg section having an interior surface for the nestable reception and engagement of an insert section; and an insert section adapted to be nestably contained within and surrounded by said lower leg section when fully assembled therewith, said insert section having the interior cavity that is shaped to receive and to nestably hold said wedge in motionless and locked engagement when said wedge is fully inserted therein, said plastic wedges are nestably contained within said receiving legs when said side rails and said at least one cross member are connected to each other, and said bed frame assembly contacts and is supported on said floor by said receiving legs, and wherein, when a said plastic wedge is inserted in a said receiving leg, said receiving leg and said plastic wedge are aligned along a vertical axis extending from a point of ground contact of the receiving leg with the floor, whereby unwanted lateral movement of said bed frame is reduced or eliminated.

2. The bed frame assembly of claim 1 wherein four interior surfaces of the interior cavity of each receiving leg taper inwardly and four exterior surfaces of each wedge taper inwardly.

3. The bed frame assembly of claim 1 wherein the lower leg section is rounded in configuration.

4. The bed frame assembly of claim 1 wherein the at least one cross member comprise three cross members having wedges located at the ends thereof.

5. The bed frame assembly of claim 1 wherein the shape of the wedge is substantially trapezoidal.

6. The bed frame assembly of claim 1 wherein the cross member has a downward vertical flange and a horizontal flange and there is a slot formed in an upper surface of the wedge to receive the vertical flange.

7. The bed frame assembly of claim 6 wherein the wedge is comprised of two half housings that are affixed together sandwiching the vertical flange therebetween.

8. The bed frame assembly of claim 1 further including a center receiving leg affixed at about the center of each of the cross members and a center member having a wedge at each end thereof that is adapted to interfit into the center receiving legs of the cross members forming a three dimensional connection.

9. A bed frame assembly positioned on a floor for supporting a mattress or mattress set, the bed frame assembly comprising side rails and at least one cross member, each side rail having at least two receiving legs for contact with said floor affixed thereto adapted to contact the floor, each receiving leg having an interior cavity with a plurality of inner surfaces, at least two of the inner surfaces being tapered inwardly in the downward direction, the at least one cross member having wedges at the ends thereof, each wedge having a plurality of exterior surfaces, and wherein at least two of the exterior surfaces are tapered inwardly in the downward direction so as to complementarily interfit with the interior cavity of the receiving legs to connect the at least one cross member to a side rail by forming a surface contact between the plastic wedge and the receiving leg, wherein said receiving legs are located at the ends of said side rails and said wedges are located at the ends of said at least one cross member, each receiving leg consisting essentially of:

a lower leg section that makes direct contact with said floor, said lower leg section having an interior surface for the nestable reception and engagement of an insert section; and an insert section adapted to be nestably contained within and surrounded by said lower leg section when fully assembled therewith, said insert section having the interior cavity that is shaped to receive and to nestably hold said wedge in motionless and locked engagement when said wedge is fully inserted therein, said wedges are nestably contained within said receiving legs when said side rails and said at least one cross member are connected to each other, and said bed frame assembly contacts and is supported on said floor by said receiving legs wherein the cross member has a downward vertical flange and a horizontal flange and there is a slot formed in an upper surface of the wedge to receive the vertical flange, and wherein there is a recess formed in the upper surface of the wedge such that the horizontal flange interfits into the recess to form a smooth continuous surface along the upper surface of the wedge and the horizontal flange, and wherein, when a said wedge is inserted in a said receiving leg, said receiving leg and said wedge are aligned along a vertical axis extending from a point of ground contact of the receiving leg with the floor, whereby unwanted lateral movement of said bed frame is reduced or eliminated.

10. A bed frame assembly positioned on a floor for supporting a mattress or mattress set, the bed frame assembly comprising side rails and at least one cross member, each side rail having at least two receiving legs affixed to the ends of said side rails adapted to contact the floor, each receiving leg having an interior cavity with an inner surface, at least part of the inner surface being tapered inwardly in the downward direction, the at least one cross member comprised of a metal structural component having opposed ends and having plastic wedges at each of the opposed ends, each plastic wedge having an upper surface wherein the metal structural component extends at least substantially across the upper surface of each plastic wedge, each plastic wedge further having an exterior side surface tapered inwardly in the downward direction so as to complementarily interfit with the interior cavity of the receiving legs to connect the at least one cross member to a side rail by forming a surface contact between the plastic wedge and the receiving leg, each receiving leg consisting essentially of:

a lower leg section that makes direct contact with said floor, said lower leg section having an interior surface for the nestable reception and engagement of an insert section; and an insert section adapted to be nestably contained within and surrounded by said lower leg section when fully assembled therewith, said insert section having the interior cavity that is shaped to receive and to nestably hold said wedge in motionless and locked engagement when said wedge is fully inserted therein, said plastic wedges are nestably contained within said receiving legs when said side rails and said at least one cross member are connected to each other, and said bed frame assembly contacts and is supported on said floor by said receiving legs, and wherein, when a said plastic wedge is inserted in a said receiving leg, said receiving leg and said plastic wedge are aligned along a vertical axis extending from a point of ground contact of the receiving leg with the floor, whereby unwanted lateral movement of said bed frame is reduced or eliminated.

* * * * *